US011767805B2

(12) United States Patent
Turior et al.

(10) Patent No.: US 11,767,805 B2
(45) Date of Patent: Sep. 26, 2023

(54) CYLINDER COVER FOR INTERNAL COMBUSTION ENGINE

(71) Applicant: FLEETGUARD FILTERS PRIVATE LIMITED, Pune (IN)

(72) Inventors: Rohan Turior, Pune (IN); Satyasheel Milind Borwankar, Pune (IN); Ajay Nehra, Pune (IN); Aditya R Pujari, Pune (IN); Sachin P Shirode, Pune (IN)

(73) Assignee: FLEETGUARD FILTERS PRIVATE LIMITED

( * ) Notice: Subject to any disclaimer, the term of this patent is extended or adjusted under 35 U.S.C. 154(b) by 0 days.

(21) Appl. No.: 17/787,627

(22) PCT Filed: Dec. 24, 2020

(86) PCT No.: PCT/IB2020/062450

§ 371 (c)(1),
(2) Date: Jun. 21, 2022

(87) PCT Pub. No.: WO2021/130725

PCT Pub. Date: Jul. 1, 2021

(65) Prior Publication Data

US 2022/0412284 A1 Dec. 29, 2022

(30) Foreign Application Priority Data

Dec. 24, 2019 (IN) ..... 201921053713

(51) Int. Cl.
*F02F 1/24* (2006.01)
*F02F 7/00* (2006.01)

(52) U.S. Cl.
CPC . *F02F 1/24* (2013.01); *F02F 7/00* (2013.01)

(58) Field of Classification Search
CPC ..... F02F 1/24; F02F 7/00; F02F 7/006; F02F 2007/0041
See application file for complete search history.

(56) References Cited

U.S. PATENT DOCUMENTS 3,842,718 A * 10/1974 Malchow ..... F02F 1/00 123/193.2
6,189,503 B1 * 2/2001 Takano ..... F02M 35/10085 123/298

(Continued)

FOREIGN PATENT DOCUMENTS

DE 4009017 A1 * 1/1991 ..... F02P 13/00
DE 4009017 A1 9/1991

(Continued)

*Primary Examiner* — Grant Moubry
*Assistant Examiner* — James G Moubry

(57) ABSTRACT

An internal combustion engine 100 comprising a cylinder head 102, a cylinder head cover 104, an intermediate flange 106 arranged between the head 102 and the head cover 104. A first opening extending from the head cover 104, through the intermediate flange, into the head 102, the first opening includes first internal threads lying inside the cylinder head area, a second opening having an integrated first threaded bolt provided at an end of the intermediate flange touching the cylinder head 102. A plurality of fasteners comprising a screw having a head, and a shaft fastening the head cover 104 and intermediate flange to the head such that the head of the screw rests directly on top of the cylinder head cover 104 when the screw is tightened.

8 Claims, 3 Drawing Sheets

(56) References Cited

U.S. PATENT DOCUMENTS

| | | | | |
|---|---|---|---|---|
| 8,740,532 | B2 * | 6/2014 | Wiebe | F16B 35/00 411/389 |
| 2006/0081205 | A1 * | 4/2006 | Fonville | F02F 7/006 123/90.37 |
| 2006/0144358 | A1 * | 7/2006 | Tripathy | F02F 7/006 123/90.38 |

FOREIGN PATENT DOCUMENTS

| | | | | |
|---|---|---|---|---|
| DE | 102008020099 | A1 * | 12/2009 | F02F 7/006 |
| EP | 2546504 | A2 * | 1/2013 | F02F 7/006 |
| EP | 2546504 | B1 | 10/2018 | |
| JP | 2009299613 | A * | 12/2009 | |
| JP | 2009299613 | A | 12/2009 | |

* cited by examiner

CYLINDER COVER FOR INTERNAL COMBUSTION ENGINE

TECHNICAL FIELD

The present disclosure relates generally to an internal combustion engine, and more specifically to a cylinder cover designed for the internal combustion engine.

BACKGROUND

Conventionally, an internal combustion engine comprises a cylinder head and a cylinder head cover. Cylinder head cover accommodates crankcase ventilation system. Typically, an intermediate flange is arranged between the cylinder head and the cylinder head cover. The intermediate flange basically provides space and protection for some intermediate components of the internal combustion engine. For example, intermediate components comprise constituents of a fuel injection system and/or components of an ignition system.

A normal life-cycle of the intermediate components requires regular maintenance for prolonged life with stable and efficient operation. This regular maintenance requirement makes the design of cylinder cover in two pieces (i.e., cylinder cover with the intermediate flange) very beneficial for users. But, making the cylinder cover in two pieces also poses a technical threat of increased mechanical vibrations affecting both pieces.

The intermediate components accommodated inside the intermediate flange and cylinder cover are naturally prone to mechanical vibrations being propagated via the cylinder head. These mechanical vibrations even affect the regular maintenance as regular tuning of the fuel injection system and/or the ignition system is required more often than systems not affected/isolated from these mechanical vibrations.

DE4009017 discloses an internal combustion engine having an intermediate flange. EP2546504B1 discloses a collar screw with designed seals & sealing arrangements for reducing mechanical vibrations and connecting the cylinder cover and the intermediate flange to the cylinder head.

The present invention deals with the internal combustion engine having the above-mentioned shortcomings and provides an improved and alternative embodiment ensuring reduced vibration exposure of the intermediate flange and the components housed therein.

SUMMARY

Embodiments of the present disclosure present technological improvements as solutions to one or more of the above-mentioned technical problems recognized by the inventor in conventional systems.

In an aspect of the present disclosure, an internal combustion engine is provided. The internal combustion engine comprises a cylinder head, a cylinder head cover, and an intermediate flange arranged between the cylinder head and the cylinder head cover. A first opening extends from the cylinder head cover, through the intermediate flange, and into the cylinder head. The first opening includes first internal threads lying inside the cylinder head area. A second opening is provided at the end of the intermediate flange which is in contact with the cylinder head and surrounds the first opening and is positioned perpendicular to the first opening.

According to aspects of the present disclosure, the internal combustion engine includes a first bolt including second internal threads and is integrated inside the second opening. A plurality of fasteners are provided for fastening the cylinder head cover and the intermediate flange to the cylinder head. The plurality of fasteners includes the screw comprising a head and a shaft including first external threads. In an alternate embodiment of the present disclosure, the plurality of fasteners includes the screw comprising only the shaft and includes a drive recess fully within the shaft of the screw. The drive recess is situated on an end opposite to the end having the first external threads. This drive recess acts as tightening means for the screw and replaces the need for having the head. It must be noted that the term screw is used to represent tightening means and other similar modifications are possible in a traditional screw with a head and a shaft.

In an aspect of the present disclosure, the first internal threads of the first opening receive the first external threads of the shaft of the screw. The second internal threads of the first bolt receive the first external threads of the shaft of the screw. The head of the screw rests directly on top of the cylinder head cover when the screw is completely tightened.

In another aspect of the present disclosure, the internal combustion engine also comprises a third opening provided at the end of the intermediate flange which is in contact with cylinder head cover. The third opening surrounds the first opening and is positioned perpendicular to the first opening.

In an aspect of the present disclosure, the internal combustion engine further comprises a second bolt. The second bolt includes third internal threads and is integrated inside the third opening. Further, the shaft of the screw also includes second external threads.

In further aspects of the present disclosure, the third internal threads of the second bolt receive the second external threads of the shaft. Further, the head of the screw rests directly on top of the cylinder head cover when the screw is completely tightened. Furthermore, the first external threads are provided at the end of the shaft which is farthest from the head and the second external threads are provided near the end of the shaft which is nearest from the head.

In yet another aspect, an internal combustion engine having a two-piece cylinder cover with reduced exposure to mechanical vibrations is provided.

Additional aspects, advantages, features and objects of the present disclosure would be made apparent from the drawings and the detailed description of the illustrative embodiments.

It will be appreciated that features of the present disclosure are susceptible to being combined in various combinations without departing from the scope of the present disclosure as defined by the below mentioned detailed description and drawings.

BRIEF DESCRIPTION OF THE ACCOMPANYING FIGURES

The summary above, as well as the following detailed description of illustrative embodiments, is better understood when read in conjunction with the appended drawings. For the purpose of illustrating the present disclosure, example constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
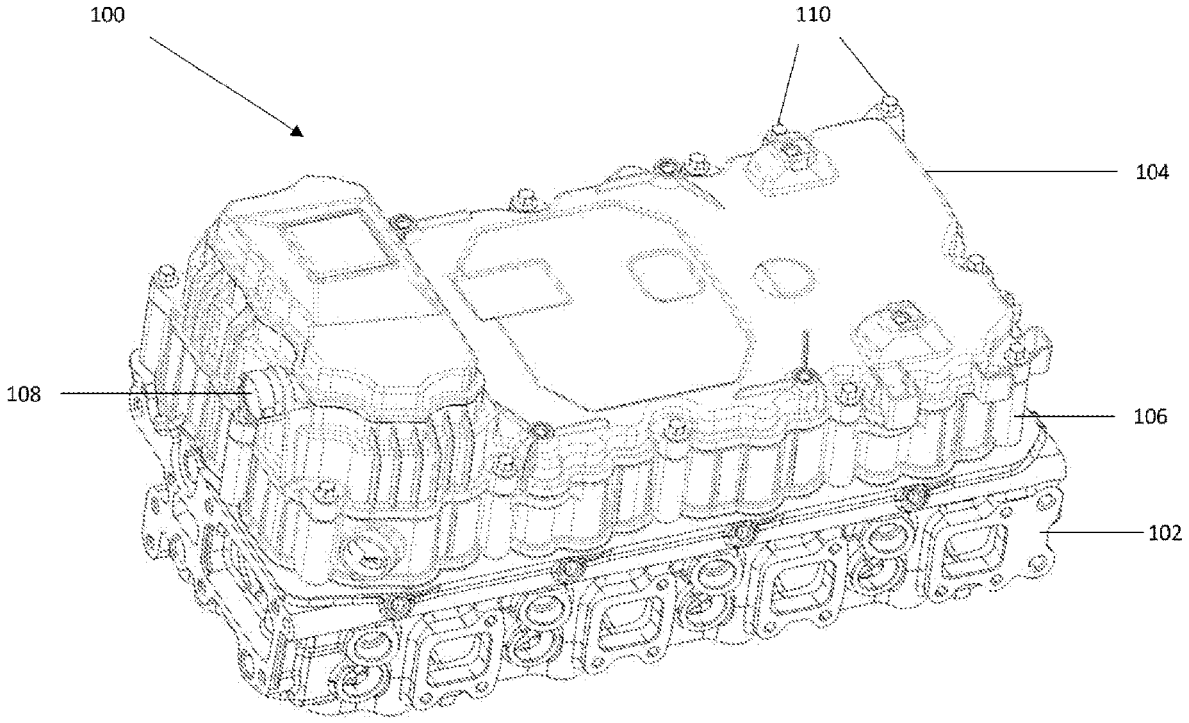
FIG. 1 is a perspective view depicting a partial region of an internal combustion engine, in accordance with an exemplary embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION

The following detailed description illustrates embodiments of the present disclosure and manners by which they can be implemented. Although some modes of carrying out the present disclosure has been disclosed, those skilled in the art would recognize that other embodiments for carrying out or practicing the present disclosure are also possible. The person skilled in the art will recognize many variations, alternatives, and modifications of the embodiments of the present disclosure. It should be understood that this invention is not limited to the particular methodology, protocols, and the like, described herein and as such may vary. The terminology used herein is for the purpose of describing particular embodiments only and is not intended to limit the scope of the present invention, which is defined solely by the claims.

Unless stated otherwise, or implicit from context, the following terms and phrases include the meanings provided below. Unless explicitly stated otherwise, or apparent from context, the terms and phrases below do not exclude the meaning that the term or phrase has acquired in the art to which it pertains. The definitions are provided to aid in describing particular embodiments of the aspects described herein, and are not intended to limit the claimed invention, because the scope of the invention is limited only by the claims. Further, unless otherwise required by context, singular terms shall include pluralities and plural terms shall include the singular.

As used herein, the term "comprising" or "comprises" is used in reference to compositions, methods, and respective component(s) thereof, that are essential to the invention, yet open to the inclusion of unspecified elements, whether essential or not.

The singular terms "a", "an", and "the" include plural references unless the context clearly indicates otherwise. Similarly, the word "or" is intended to include "and" unless the context clearly indicates otherwise. Thus, for example, references to the "method" includes one or more methods, and/or steps of the type described herein, and/or which will become apparent to those persons skilled in the art upon reading this disclosure and so forth.

Although methods and materials similar or equivalent to those described herein can be used in the practice or testing of this disclosure, suitable methods and materials are described below. The term "comprises" means "includes". The abbreviation, "e.g.," is derived from the Latin exempli gratia and is used herein to indicate a non-limiting example. Thus, the abbreviation "e.g.," is synonymous with the term "for example".

In an aspect of the present disclosure, an internal combustion engine is provided. The internal combustion engine comprises a cylinder head, a cylinder head cover, and an intermediate flange arranged between the cylinder head and the cylinder head cover. A first opening extends from the cylinder head cover, through the intermediate flange, and into the cylinder head. The first opening includes first internal threads lying inside the cylinder head area. A second opening is provided at the end of the intermediate flange which is in contact with the cylinder head and surrounds the first opening and is positioned perpendicular to the first opening.

According to aspects of the present disclosure, the internal combustion engine includes a first bolt including second internal threads and is integrated inside the second opening. A plurality of fasteners are provided for fastening the cylinder head cover and the intermediate flange to the cylinder head. The plurality of fasteners includes the screw comprising a head and a shaft including first external threads. In an alternate embodiment of the present disclosure, the plurality of fasteners includes the screw comprising only the shaft and includes a drive recess fully within the shaft of the screw. The drive recess is situated on an end opposite to the end having the first external threads. This drive recess acts as tightening means for the screw and replaces the need for having the head. It must be noted that the term screw is used to represent tightening means and other similar modifications are possible in a traditional screw with a head and a shaft In an aspect of the present disclosure, the first internal threads of the first opening receive the first external threads of the shaft of the screw. The second internal threads of the first bolt receive the first external threads of the shaft of the screw. The head of the screw rests directly on top of the cylinder head cover when the screw is completely tightened.

In another aspect of the present disclosure, the internal combustion engine also comprises a third opening provided at the end of the intermediate flange which is in contact with cylinder head cover. The third opening surrounds the first opening and is positioned perpendicular to the first opening.

In an aspect of the present disclosure, the internal combustion engine further comprises a second bolt. The second bolt includes third internal threads and is integrated inside the third opening. Further, the shaft of the screw also includes second external threads.

In further aspects of the present disclosure, the third internal threads of the second bolt receive the second external threads of the shaft. Further, the head of the screw rests directly on top of the cylinder head cover when the screw is completely tightened. Furthermore, the first external threads are provided at the end of the shaft which is farthest from the head and the second external threads are provided near the end of the shaft which is nearest from the head.

Embodiments of the present disclosure substantially eliminate, or at least partially address, problems in the prior art, and assist the internal combustion engine manufacturers, consumers, and suppliers.

Referring now to the drawings, particularly by their reference numbers, FIG. 1 illustrates an internal combustion engine 100 depicted only partially in a perspective view, in accordance with an embodiment of the present disclosure. The internal combustion engine 100 includes a cylinder head 102, a cylinder head cover 104, and an intermediate flange 106. In an embodiment, the cylinder head cover 104 includes an outlet 108 for a crankcase ventilation system (not shown) of the internal combustion engine 100.

As may be seen, the intermediate flange 106 is positioned between the cylinder head 102 and the cylinder head cover 104. In an embodiment, the intermediate flange 106 provides space for arranging constituents of a fuel injection system (not shown) and/or components of an ignition system (not shown) of the internal combustion engine 100. The cylinder head 102, the cylinder head cover 104, and the intermediate flange 106 are mounted along a direction X-X'.

In an aspect of the present disclosure, a plurality of fasteners 110 are provided to fasten the cylinder head cover 104 and the intermediate flange 106 to the cylinder head 102 and are arranged parallel to the direction X-X'. As illustrated, the plurality of fasteners 110 are arranged along the circumferential contour of the cylinder head cover 104 and the intermediate flange 106.

FIG. 1 is merely an example. A person skilled in the art will recognize many variations, alternatives, and modifications of the embodiments of the present disclosure.

Figure 2:
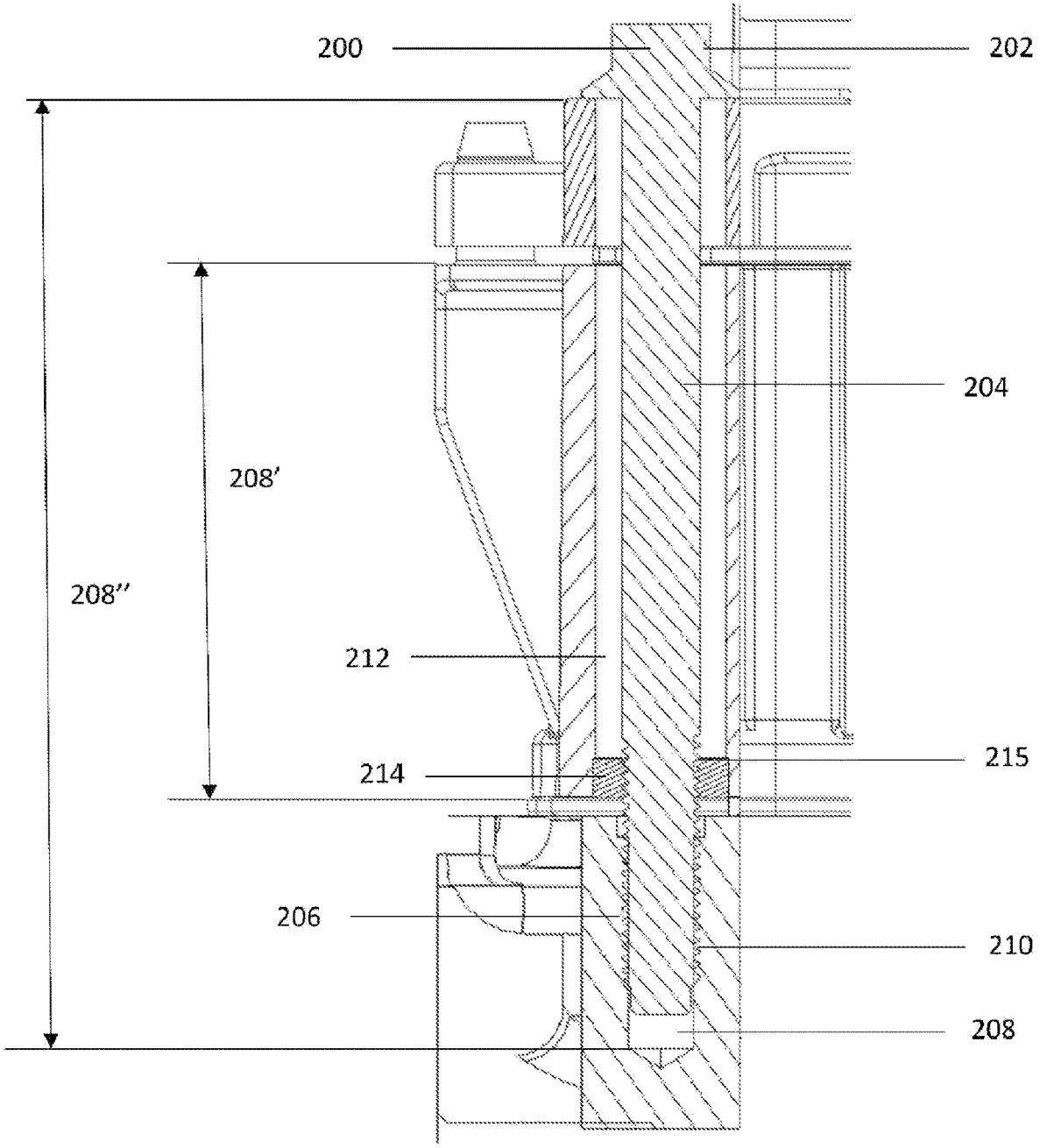
FIG. 2 depicts a front cross-sectional view of the partial region of the internal combustion engine of FIG. 1, in accordance with an exemplary embodiment of the present disclosure.

FIG. 2 depicts a front cross-sectional view of the internal combustion engine 100 depicted in FIG. 1. As illustrated in the view, the plurality of fasteners 110 comprise a screw 200. As may be further seen, the screw 200 fastens the cylinder head cover 104 and the intermediate flange 106 to the cylinder head 102.

According to embodiments of the present disclosure, the screw 200 comprises a head 202 and a shaft 204. As illustrated, the head 202 rests directly on the top of the cylinder head cover 104 when completely tightened. The shaft 204 includes first external threads 206 provided at the end of the shaft 204 which is farthest from the head 202, according to an embodiment of the present disclosure. The first external threads 206 are provided for fastening the cylinder head cover 104 and the intermediate flange 106 to the cylinder head 102.

According to an alternate embodiment, the screw 200 comprises only the shaft 204 and includes a drive recess (not shown) fully within the shaft 204 of the screw 200. The drive recess (not shown) is situated on an end opposite to the end having the first external threads 206. This drive recess (not shown) acts as tightening means for the screw 200 and replaces the need for having the head 202. It must be noted that the term screw is used to represent tightening means and other similar modifications are possible in a traditional screw with a head and a shaft.

Further referring to FIG. 2, a first opening 208 is provided in the cylinder head cover 104 and extends parallel to the X-X' direction into the intermediate flange 106 and finally extends into the cylinder head 102. In an embodiment of the present disclosure, the first opening 208 is shaped in such a manner that it receives the shaft 204 of the screw 200. A first portion 208' of the first opening 208 lying inside the cylinder head 102 includes first internal threads 210 for receiving the first external threads 206 of the shaft 204, according to embodiments of the present disclosure.

Again, referring to FIG. 2, a second opening 212 is provided in the intermediate flange 106 and extends perpendicular to the X-X' direction. The second opening 212 is provided at the end of the intermediate flange 106 which is in contact with the cylinder head 102, according to an embodiment of the present disclosure. In various embodiments of the present disclosure, the second opening 212 is positioned around a second portion 208" of the first opening 208 lying inside the intermediate flange 106.

According to embodiments of the present disclosure, a first bolt 214 is integrated inside the second opening 212 provided in the intermediate flange 106. In another embodiment of the present disclosure, the first bolt 214 is removably integrated inside the second opening 212. The first bolt 214 is shaped in such a manner that it receives the first external threads 206 of the shaft 204 of the screw 200, according to various embodiments of the present disclosure In an embodiment of the present disclosure, the first bolt 214 includes second internal threads 216 for receiving the first external threads 206 of the shaft 204. The first bolt 214 may be made of an elastic material or a plastic material to absorb/reduce the mechanical vibrations, according to an embodiment of the present disclosure. The first bolt 214 may be made of a metallic material, according to another embodiment of the present disclosure.

FIG. 2 is merely an example. A person skilled in the art will recognize many variations, alternatives, and modifications of the embodiments of the present disclosure.

Figure 3:
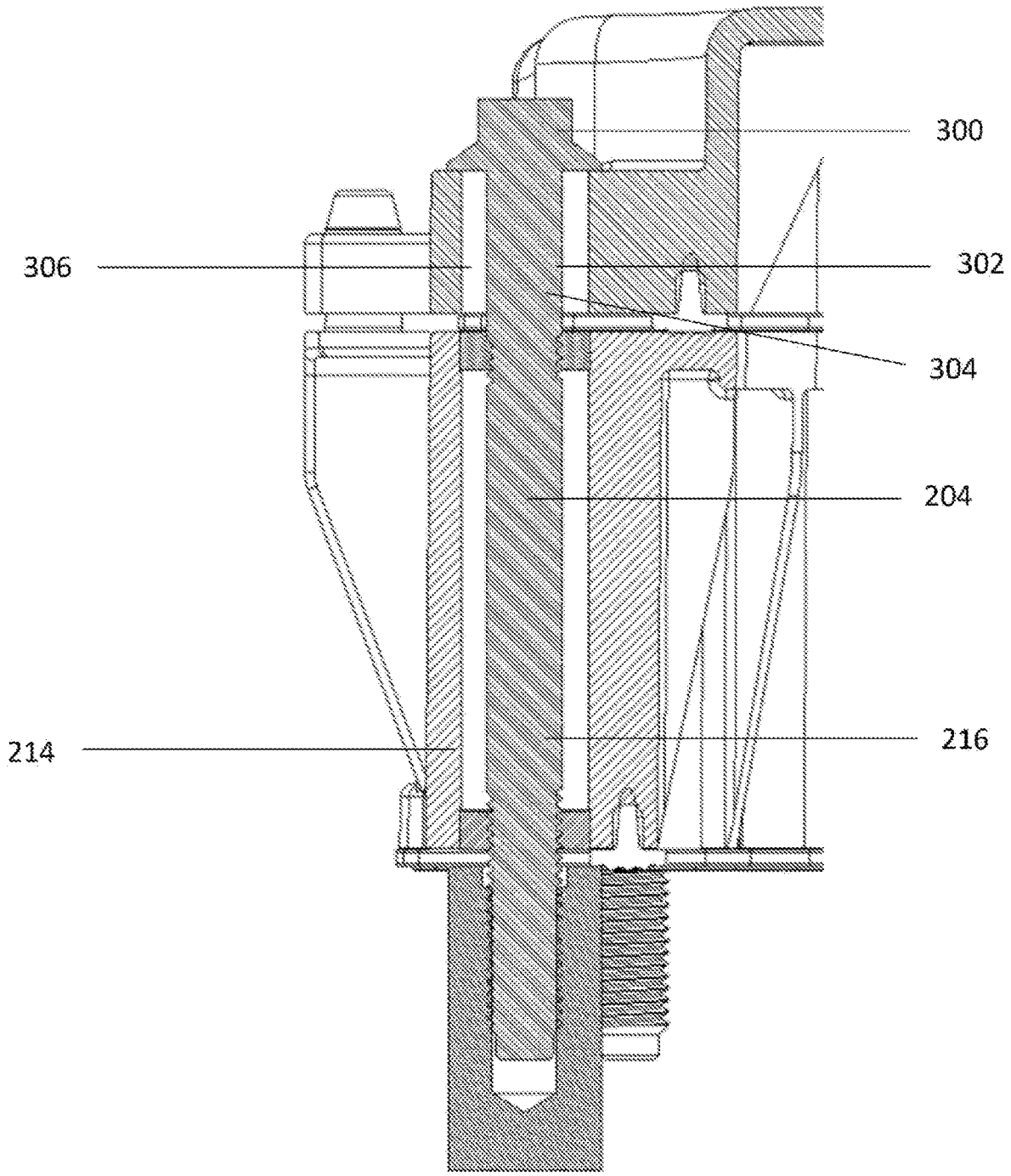
FIG. 3 illustrates a front cross-sectional view of the partial region of the internal combustion engine of FIG. 1, in accordance with another exemplary embodiment of the present disclosure.

Moving on to FIG. 3, a front cross-sectional view of the internal combustion engine 100 of FIG. 1 is depicted. As may be seen, FIG. 3 illustrates another embodiment of arrangements shown in FIG. 2.

A third opening 300 is provided in the intermediate flange 106 and extends perpendicular to the X-X' direction, according to various embodiments of the present disclosure. The third opening 300 is provided at the end of the intermediate flange 106 which is in contact with the cylinder head cover 104, according to an embodiment of the present disclosure. In various embodiments of the present disclosure, the third opening 300 is positioned around the second portion 208" of the first opening 208 lying inside the intermediate flange 106.

Again, referring to FIG. 3, a second bolt 302 is integrated inside the third opening 300 provided in the intermediate flange 106. In another embodiment of the present disclosure, the second bolt 302 is removably integrated inside the third opening 300. The shaft 204 of the screw 200 includes second external threads 304 provided near the end of the shaft 204 which is nearest from the head 202, according to an embodiment of the present disclosure. The second bolt 302 is integrated inside the third opening 300 in such a manner that it receives the second external threads 304 of the shaft 204 of the screw 200.

In an embodiment of the present disclosure, the second bolt 302 includes third internal threads 306 for receiving the second external threads 304 of the shaft 204. The second bolt 302 may be made of an elastic material or a plastic material to absorb/reduce the mechanical vibrations, according to an embodiment of the present disclosure. The second bolt 302 may be made of a metallic material, according to another embodiment of the present disclosure.

According to embodiments of the present disclosure, the first bolt 214 and the second bolt 302 are integrated on both ends of the intermediate flange 106. The first bolt 214 and the second bolt 302 receive the first external threads 206 and the second external threads 304 of the shaft 204, respectively, according to embodiments of the present disclosure.

The first internal threads 210 receive the first external threads 206 providing a metal-to-metal contact, according to embodiments of the present disclosure. In various aspects of the present disclosure, the second internal threads 216 receive the first external threads 206 providing an elastic-to-metal contact. The third internal threads 306 receive the second external threads 304 providing another elastic-to-metal contact, according to various embodiments of the present disclosure.

FIG. 3 is merely an example. A person skilled in the art will recognize many variations, alternatives, and modifications of the embodiments of the present disclosure.

Embodiments of the present disclosure can be used for various purposes, including, though not limited to, manufacturing and servicing of the internal combustion engines.

Modifications to various embodiments of the present disclosure described in the foregoing are possible without departing from the scope of the present disclosure as defined by the accompanying claims. Expressions such as "including", "comprising", "incorporating". "consisting of", "have", "is" used to describe and claim the present disclosure are intended to be construed in a non-exclusive manner, namely allowing for items, components or elements not explicitly described also to be present. Reference to the singular is also to be construed to relate to the plural.

What is claimed is:

1. An internal combustion engine comprising:
a cylinder head;
a cylinder head cover;
an intermediate flange arranged between the cylinder head and the cylinder head cover;
a first opening extending from the cylinder head cover, through the intermediate flange, and into the cylinder head, the first opening includes first internal threads lying inside the cylinder head;
a second opening provided at the end of the intermediate flange which is in contact with the cylinder head, the second opening surrounds the first opening;
a third opening provided at the end of the intermediate flange, which is in contact with the cylinder head cover, the third opening surrounds the first opening;
a first bolt, the first bolt includes second internal threads and is integrated inside the second opening;
a second bolt, the second bolt includes third internal threads and is integrated inside the second opening;
a plurality of fasteners for fastening the cylinder head cover and the intermediate flange to the cylinder head, the plurality of fasteners comprising:
a screw, the screw comprising:
a head, and
a shaft, the shaft includes first external threads and second external threads;
characterized in that:
the first internal threads of the first opening receive the first external threads of the shaft of the screw;
the second internal threads of the first bolt receive the first external threads of the shaft of the screw;
the third internal threads of the second bolt receive the second external threads of the shaft; and
the head of the screw rests directly on top of the cylinder head cover when the screw is completely tightened.

2. The internal combustion engine as claimed in claim 1, wherein the first opening is shaped to receive the shaft of the screw.

3. The internal combustion engine as claimed in claim 1, wherein the first bolt is removably integrated inside the second opening.

4. The internal combustion engine as claimed in claim 1, wherein the first external threads are provided at the end of the shaft which is farthest from the head.

5. The internal combustion engine as claimed in claim 1, wherein the second bolt is removably integrated inside the third opening.

6. An internal combustion engine comprising:
a cylinder head;
a cylinder head cover;
an intermediate flange arranged between the cylinder head and the cylinder head cover;
a first opening extending from the cylinder head cover, through the intermediate flange, and into the cylinder head, the first opening includes first internal threads lying inside the cylinder head;
a second opening provided at the end of the intermediate flange, which is in contact with the cylinder head, the second opening surrounds the first opening;
a third opening provided at the end of the intermediate flange, which is in contact with the cylinder head cover, the third opening surrounds the first opening;
a first bolt, the first bolt includes second internal threads and is integrated inside the second opening;
a second bolt, the second bolt includes third internal threads and is integrated inside the third opening;
a plurality of fasteners for fastening the cylinder head cover and the intermediate flange to the cylinder head, the plurality of fasteners comprising:
a screw, the screw comprising:
a head, and
a shaft, the shaft includes first external threads and second external threads;
characterized in that:
the first internal threads of the first opening receive the first external threads of the shaft;
the second internal threads of the first bolt receive the first external threads of the shaft;
the third internal threads of the second bolt receive the second external threads of the shaft; and
the head of the screw rests directly on top of the cylinder head cover when the screw is completely tightened.

7. The internal combustion engine as claimed in claim 6, wherein the first bolt and the second bolt are removably integrated inside the second opening and the third opening, respectively.

8. The internal combustion engine as claimed in claim 6, wherein the first external threads are provided at the end of the shaft which is farthest from the head and the second external threads are provided near the end of the shaft which is nearest from the head.

* * * * *